US010211571B2

(12) United States Patent
Khorrami et al.

(10) Patent No.: US 10,211,571 B2
(45) Date of Patent: Feb. 19, 2019

(54) ELECTRICAL CONNECTOR ASSEMBLY WITH LOCKING STRUCTURES THEREOF

(71) Applicant: FOXCONN INTERCONNECT TECHNOLOGY LIMITED, Grand Cayman (KY)

(72) Inventors: Kamyar Khorrami, Orange, CA (US); Wei-Te Chung, San Jose, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/892,391

(22) Filed: Feb. 8, 2018

(65) Prior Publication Data

US 2018/0241154 A1 Aug. 23, 2018

Related U.S. Application Data

(60) Provisional application No. 62/461,249, filed on Feb. 21, 2017.

(51) Int. Cl.
*H01R 24/00* (2011.01)
*H01R 13/639* (2006.01)
(Continued)

(52) U.S. Cl.
CPC ..... *H01R 13/639* (2013.01); *H01R 12/737* (2013.01); *H01R 13/6273* (2013.01);
(Continued)

(58) Field of Classification Search
CPC ..... H01R 13/639; H01R 12/737; H01R 13/6273; H01R 13/6581; H01R 12/722; H01R 24/60; H01R 2107/00
(Continued)

(56) References Cited

U.S. PATENT DOCUMENTS 6,692,286 B1 2/2004 De Cet
9,065,207 B2 6/2015 Chapel et al.
(Continued)

OTHER PUBLICATIONS

Universal Serial Bus Type-C Cable and Connector Specification Revision 1.0 Aug. 11, 2014.

*Primary Examiner* — Khiem Nguyen
(74) *Attorney, Agent, or Firm* — Wei Te Chung; Ming Chieh Chang

(57) ABSTRACT

A receptacle connector includes an insulative housing equipped with a plurality of receptacle contacts and enclosed by a capsular metallic shield sub-assembly. An insulative holder encloses the shield sub-assembly with a deflectable latching structure thereon. The plug connector includes an insulative body equipped with a plurality of plug contacts. An internal PCB is located behind the housing and soldered with the corresponding contacts. A capsular metallic shell encloses the insulative body and adapted to be received within the metallic shield during mating. A cable is connected to the PCB. An insulative cover encloses the internal PCB, the rear portion of the insulative body and the front portion of the cable with a retaining structure to be coupled with the latching structure, and a sliding assurance structure ensuring the latching structure and the retaining structure to be securely engaged with each other for maintaining the reliable mating.

19 Claims, 23 Drawing Sheets

(51) Int. Cl.

| | |
|---|---|
| ***H01R 13/627*** | (2006.01) |
| ***H01R 12/73*** | (2011.01) |
| ***H01R 13/6581*** | (2011.01) |
| *H01R 12/72* | (2011.01) |
| *H01R 24/60* | (2011.01) |
| *H01R 107/00* | (2006.01) |

(52) U.S. Cl.
CPC ..... *H01R 13/6581* (2013.01); *H01R 12/722* (2013.01); *H01R 24/60* (2013.01); *H01R 2107/00* (2013.01)

(58) Field of Classification Search
USPC ..... 439/83, 352–357, 660
See application file for complete search history.

(56) References Cited

U.S. PATENT DOCUMENTS

| | | | | |
|---|---|---|---|---|
| 9,281,629 | B2 | 3/2016 | Little et al. | |
| 9,431,763 | B2 * | 8/2016 | Chapel | H01R 13/20 |
| 9,496,653 | B2 | 11/2016 | Little et al. | |
| 10,020,616 | B2 * | 7/2018 | Hartman | H01R 43/26 |
| 2012/0115348 | A1 * | 5/2012 | Reaves | H01R 13/639 439/357 |

* cited by examiner

ELECTRICAL CONNECTOR ASSEMBLY WITH LOCKING STRUCTURES THEREOF

BACKGROUND OF THE INVENTION

1. Field of the Invention

The present invention relates to an electrical connector assemblies, especially to the USB (Universal Serial Bus) Type C connector assembly with locking devices thereof for assuring reliable mating between the plug connector and the receptacle connector.

2. Description of Related Arts

USB Type C cable and connector specification was issued on Aug. 11, 2014, and the USB Type C connectors are more and more popular in the field. Apparently, no locking devices are provided upon the Type C connectors for assuring reliable mating between the plug connector and the receptacle connector. Anyhow, for some conventional connectors it is also popular to have the plug connector equipped with a moveable (either deflectable or pivotal) latch engaged with the corresponding receptacle connector, thus assuring mating between the plug connector and the receptacle connector. U.S. Pat. No. 6,692,286 further discloses the plug connector equipped with a hybrid type latching structure, i.e., the deflectable clamping sleeve actuated by the sliding locking sleeve with a radial deformation thereof.

On the other hand, in the traditional Type C connector assembly the plug connector and the corresponding receptacle connector are essentially to have the corresponding capsular mating shield/shell exposed to an exterior during mating, as shown in U.S. Pat. No. 9,281,629 (FIG. 11, the right angle/horizontal type) and U.S. Pat. No. 9,496,653 (FIGS. 52-53, the upstanding type). Notably, such a mating arrangement may not provide sufficient reinforced structure for mating/un-mating, thus tending to jeopardize the corresponding structures due to the relatively large mating forces imposed upon the relatively small mating port, i.e., 8.34 mm×2.56 mm The invention is to provide the Type C connector assembly with not only the latching device but also the reinforcement structure for reliable long life mating.

SUMMARY OF THE INVENTION

A USB Type C connector assembly includes a plug connector with a cable connected therewith, and a receptacle connector upstanding upon a printed circuit board. The receptacle connector includes an insulative housing equipped with a plurality of receptacle contacts and enclosed by a capsular metallic shield sub-assembly. An insulative holder encloses the shield sub-assembly with a deflectable latching structure thereon. The plug connector includes an insulative body equipped with a plurality of a plurality of plug contacts. An internal PCB (printed circuit board) is located behind the housing and soldered with the corresponding contacts. A capsular metallic shell encloses the insulative body and adapted to be received within the metallic shield during mating. A cable is connected to the PCB. An insulative cover encloses the internal PCB, the rear portion of the insulative body and the front portion of the cable with a retaining structure to be coupled with the latching structure, and a sliding assurance structure ensuring the latching structure and the retaining structure to be securely engaged with each other for maintaining the reliable mating. A spring is assembled to the insulative cover to constantly urge the assurance structure to be located at the locking position where the latching structure and the retaining structure are engaged with each other. The insulative holder of the receptacle connector cooperates with the cover of the plug connector provides not only the reinforcement and protection effects with regard to the capsular metallic shield of the receptacle connector for enduring the relatively large mating forces therewith, but also the latching effect between the plug connector and the receptacle connector for assuring mating therebetween.

Other objects, advantages and novel features of the invention will become more apparent from the following detailed description when taken in conjunction with the accompanying drawings.

DETAILED DESCRIPTION OF THE PREFERRED EMBODIMENT

Figure 1A:
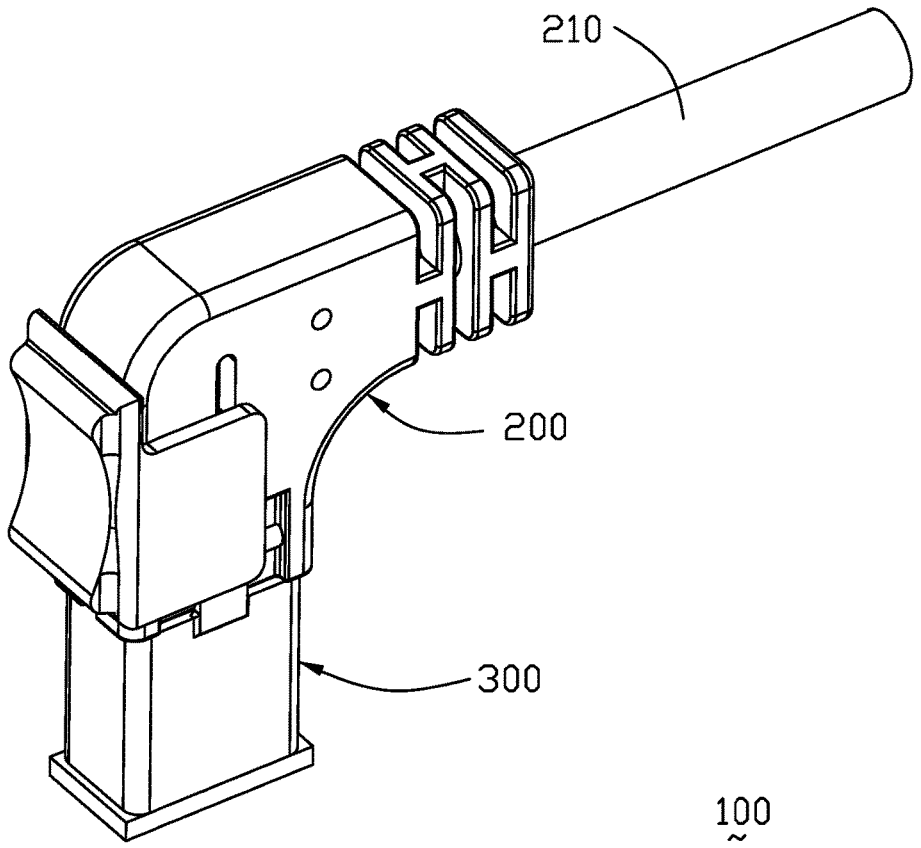
FIG. 1(A) is a perspective view of an electrical connector assembly including a plug connector and a receptacle connector mated with each other according to a presently preferred embodiment of the invention wherein the sliding assurance structure is moved to a locking position.
Figure 1B:
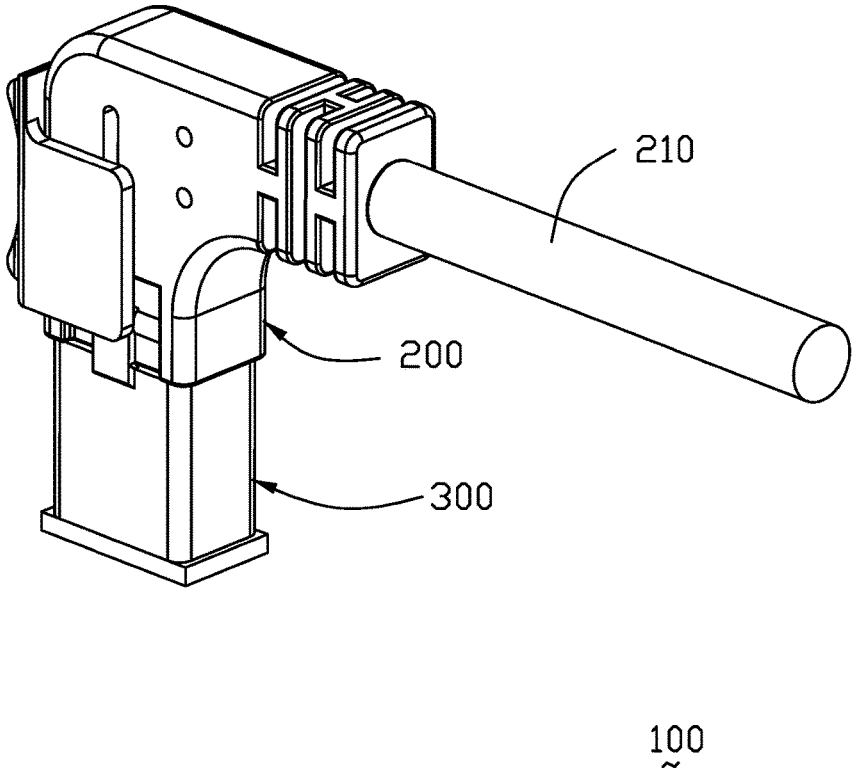
FIG. 1(B) is another perspective view of the electrical connector assembly of FIG. 1(A)
Figure 2A:
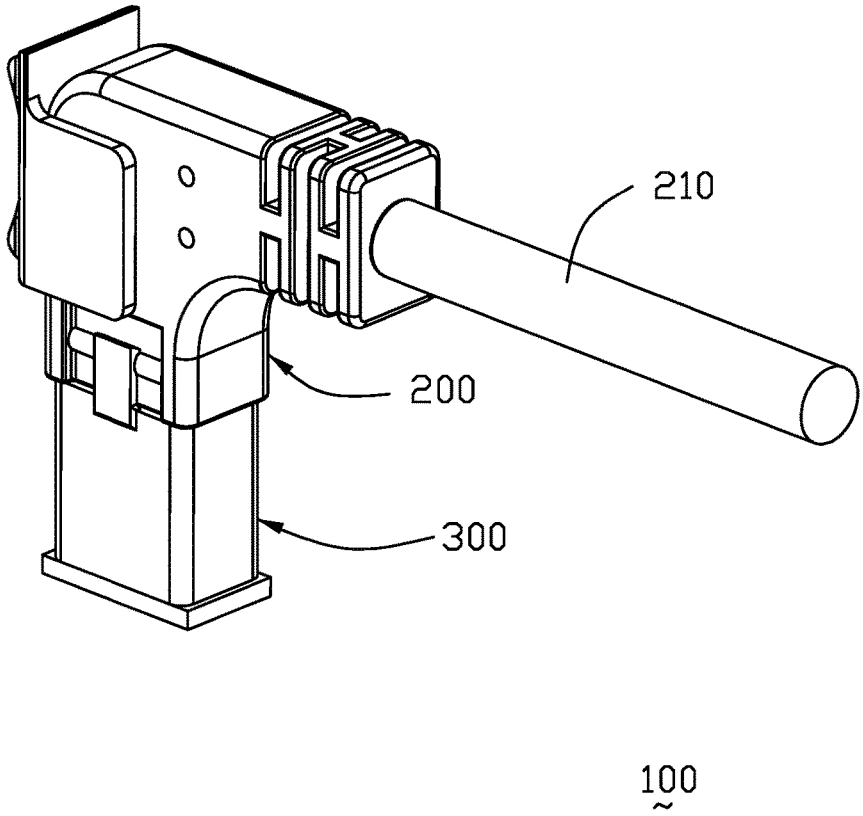
FIG. 2(A) is a perspective view of the electrical connector assembly of FIG. 1 wherein the sliding assurance structure is moved to an unlocking position.
Figure 2B:
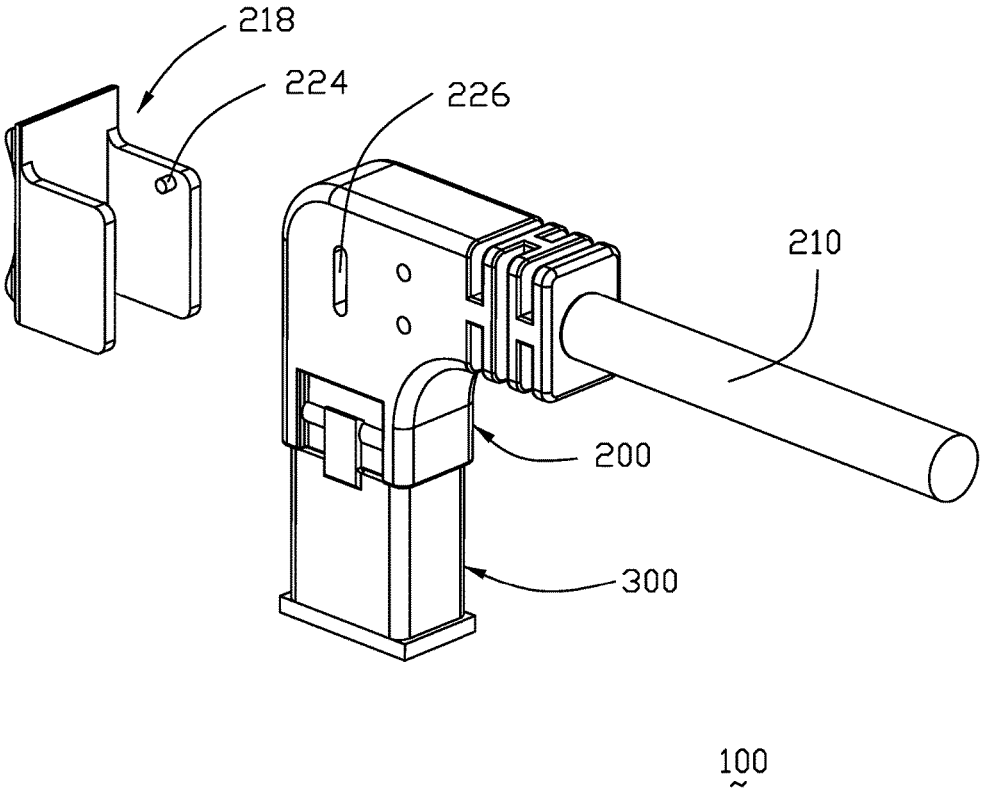
FIG. 2(B) is an exploded perspective view of the electrical connector assembly of FIG. 2(A) wherein the sliding assurance structure is removed away from the cover of the plug connector.
Figure 3A:
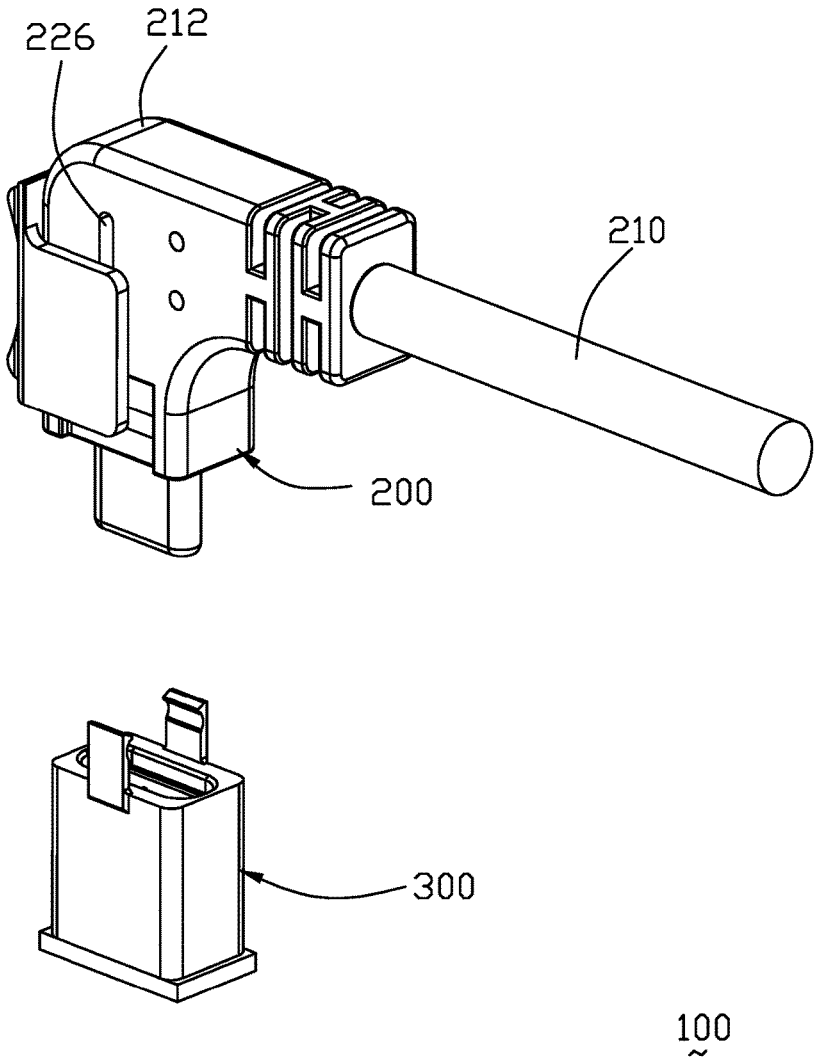
FIG. 3(A) is an exploded perspective view of the electrical connector assembly of FIG. 1(A) wherein the plug connector is removed from the receptacle connector.
Figure 3B:
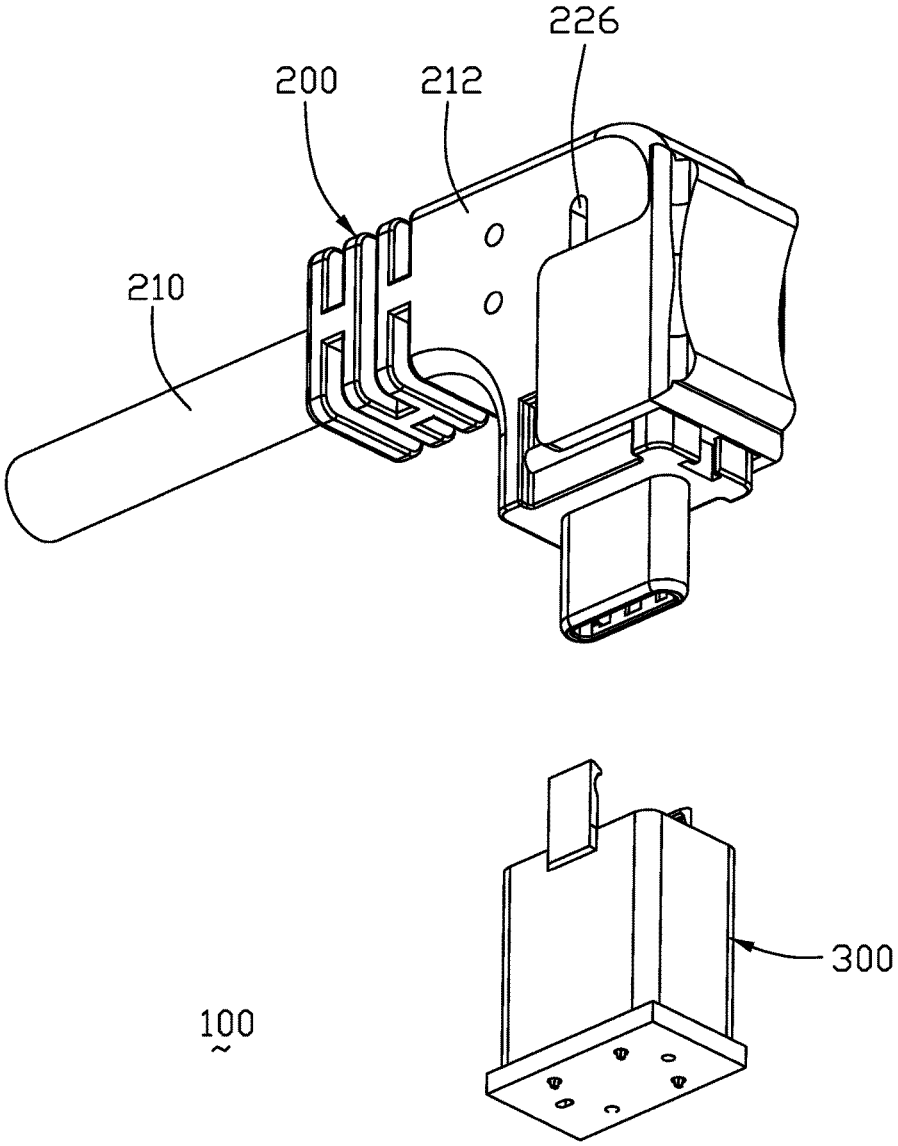
FIG. 3(B) is another exploded perspective view of the electrical connector assembly of FIG. 3(A)
Figure 3C:
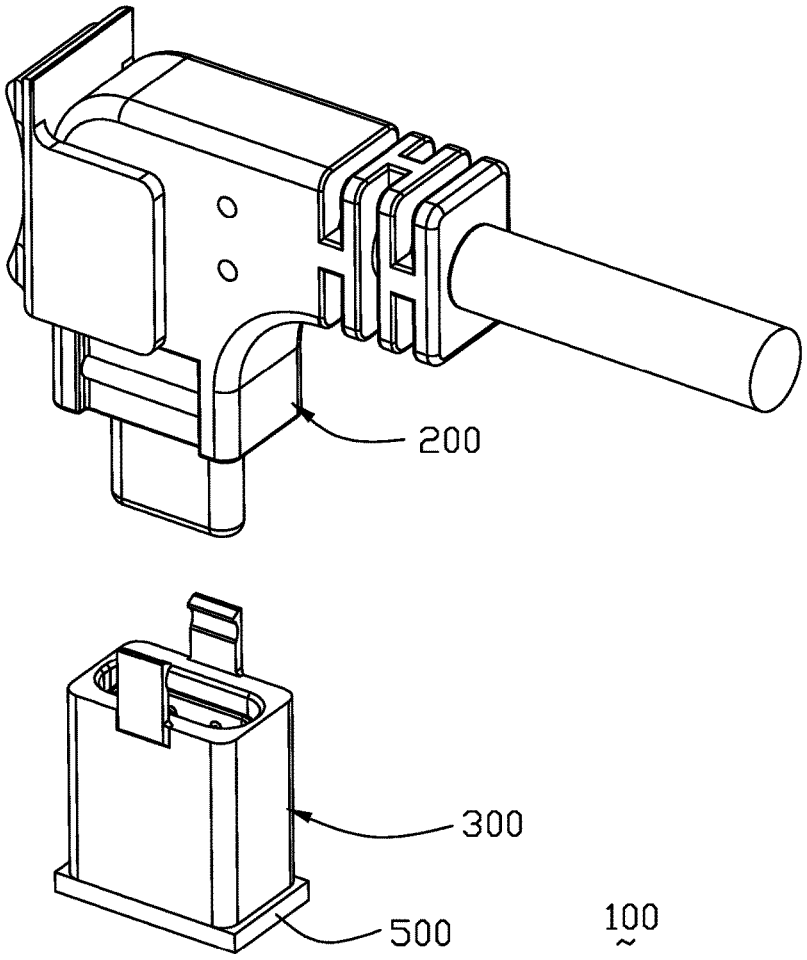
FIG. 3(C) is another exploded perspective view of the electrical connector assembly of FIG. 3(A) wherein the sliding assurance structure is located at the unlocking position.
Figure 4A:
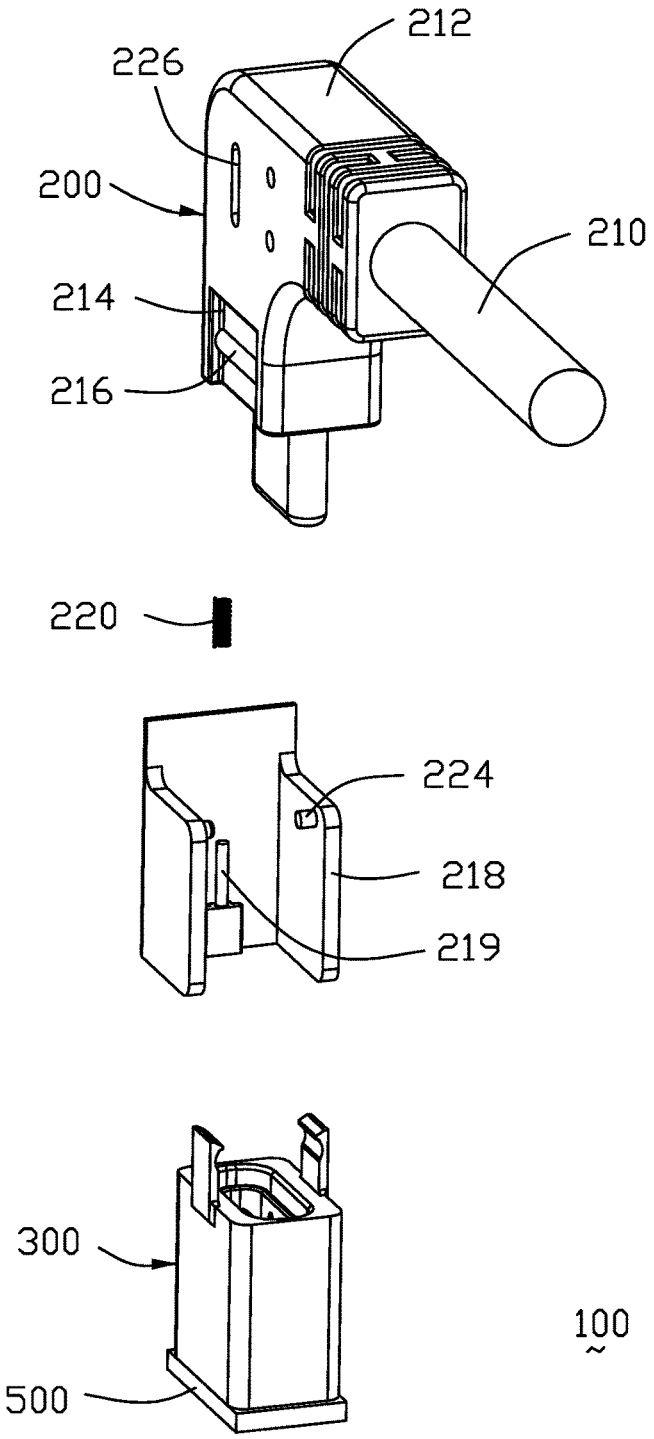
FIG. 4(A) is a further exploded perspective view of the electrical connector assembly of FIG. 3(A) wherein the sliding assurance structure is removed from the cover of the plug connector.
Figure 4B:
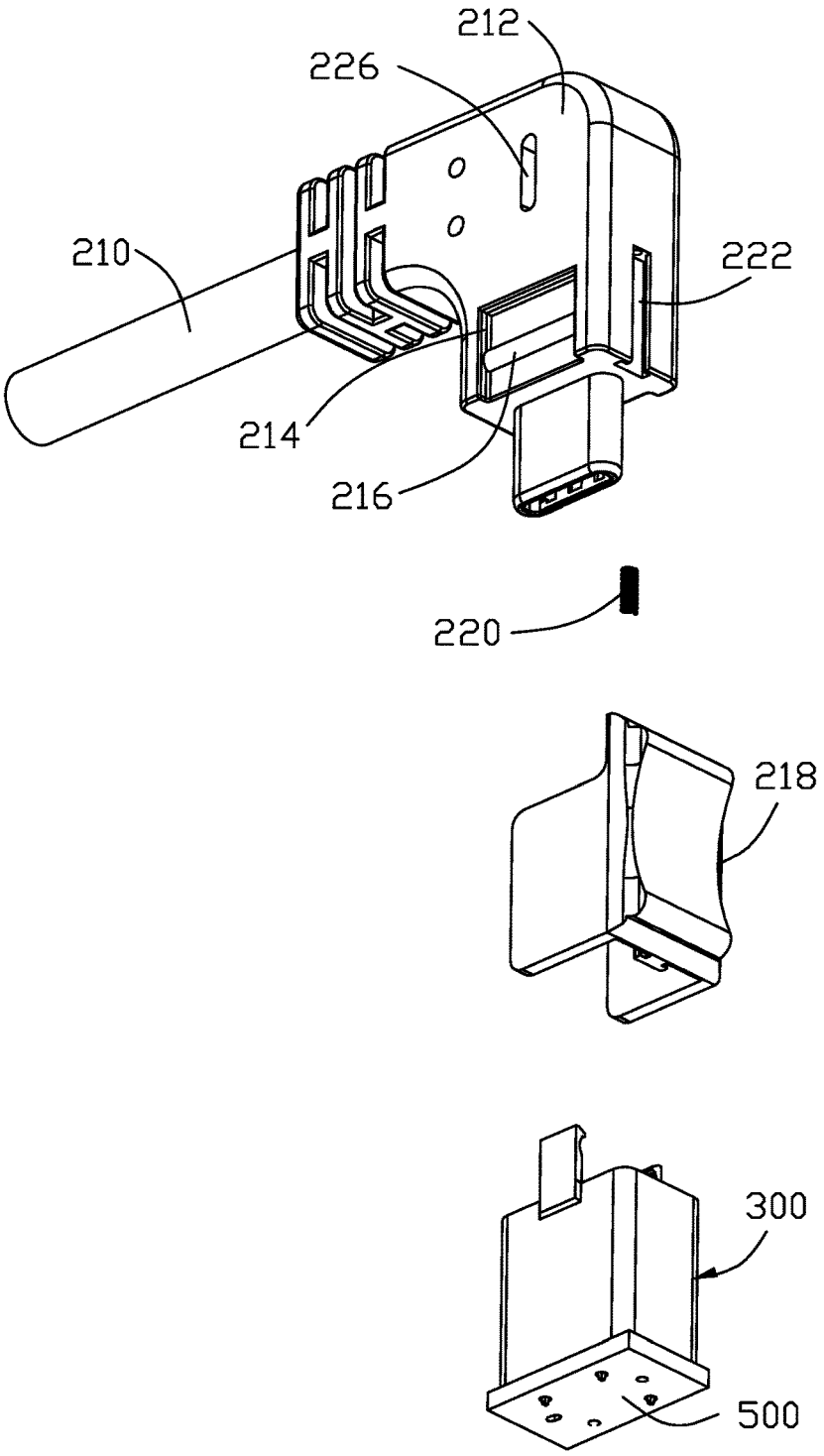
FIG. 4(B) is another exploded perspective view of the electrical connector assembly of FIG. 4(A)
Figure 5:
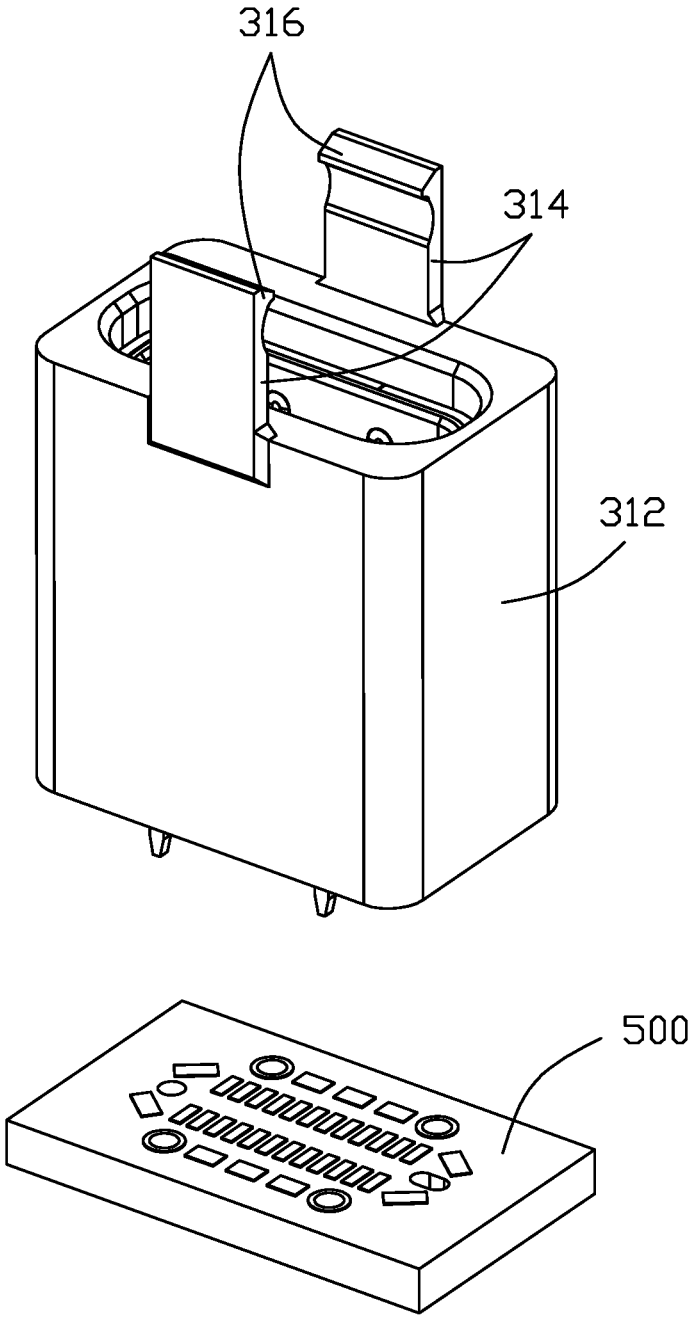
FIG. 5 is an exploded perspective view of the receptacle connector of the electrical connector assembly of FIG. 1(A) adapted to be mounted on the PCB.
Figure 6A:
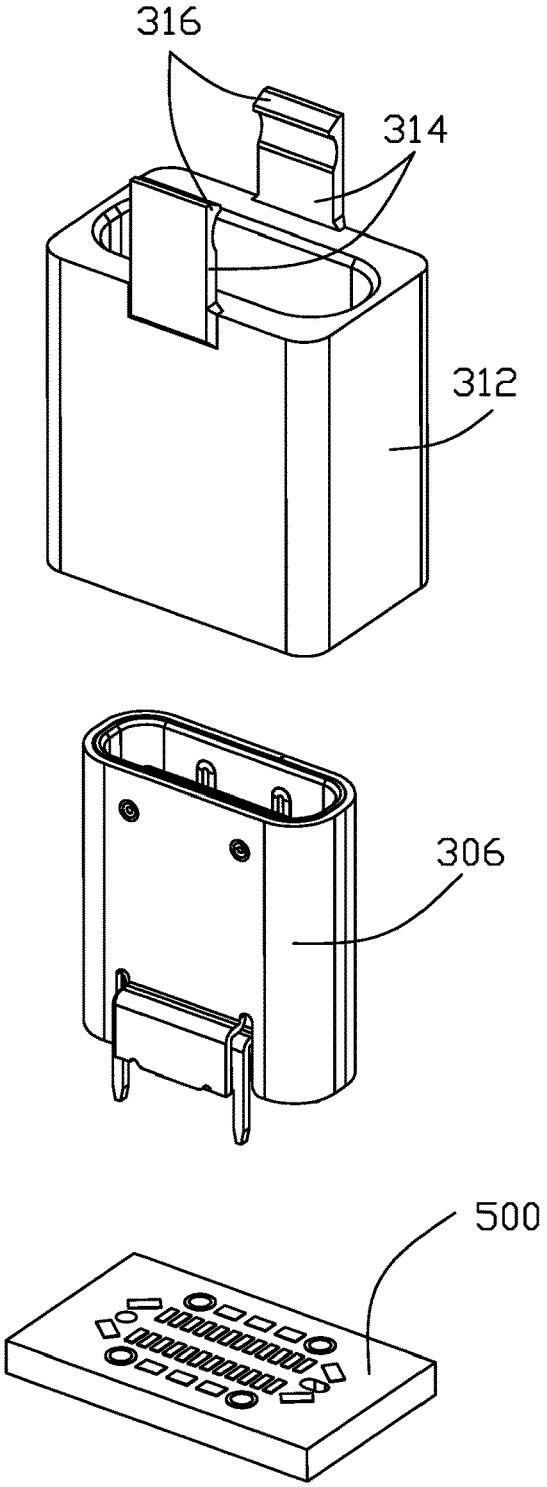
FIG. 6(A) is a further exploded perspective view of the receptacle connector of FIG. 5 adapted to be mounted upon the PCB.
Figure 6B:
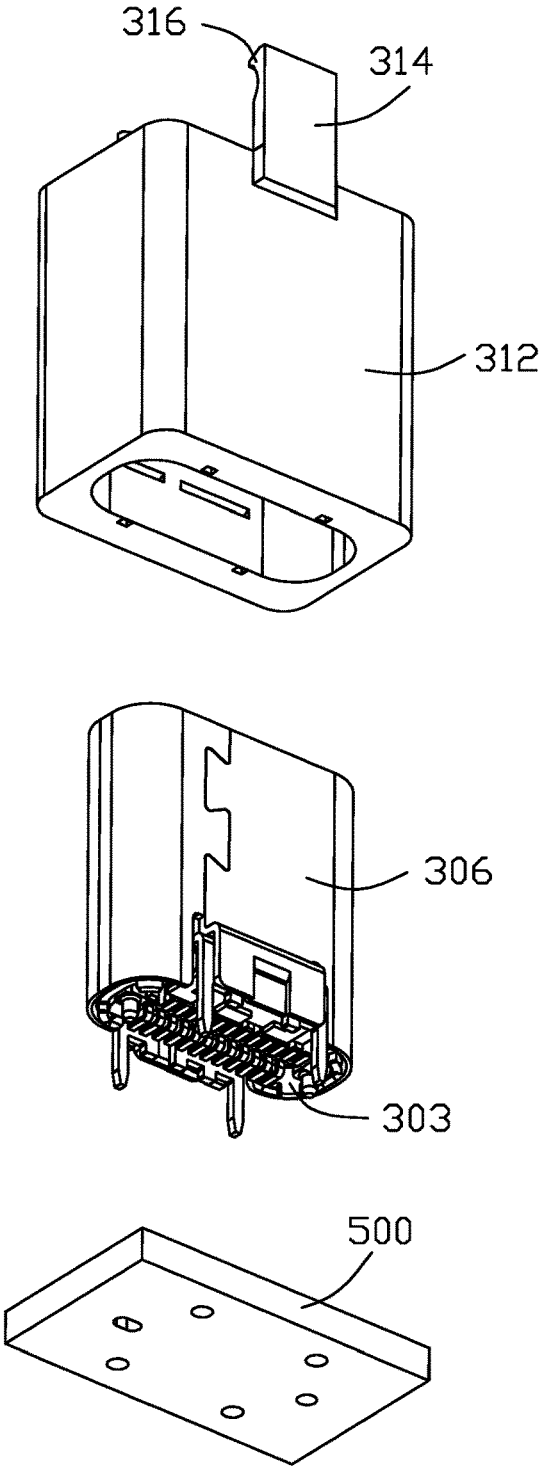
FIG. 6(B) is another exploded perspective view of the receptacle connector of FIG. 6(A)
Figure 7:
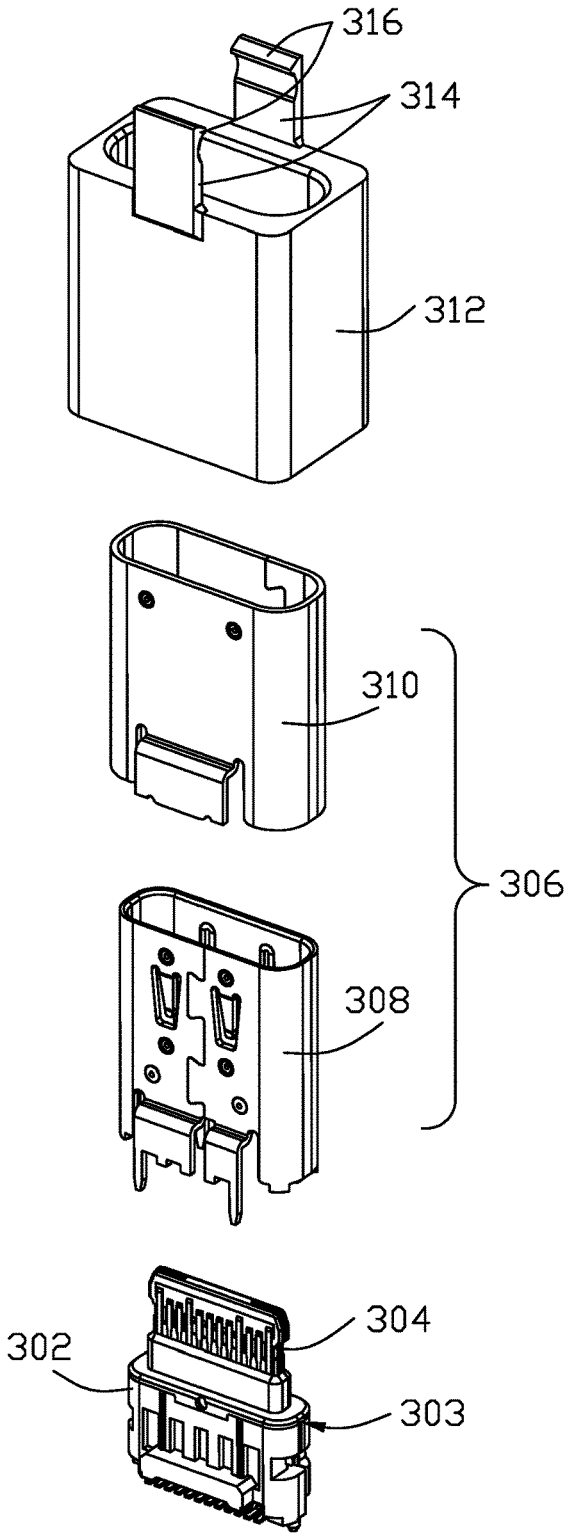
FIG. 7 is a further exploded perspective view of the receptacle connector of FIG. 6(A)
Figure 8A:
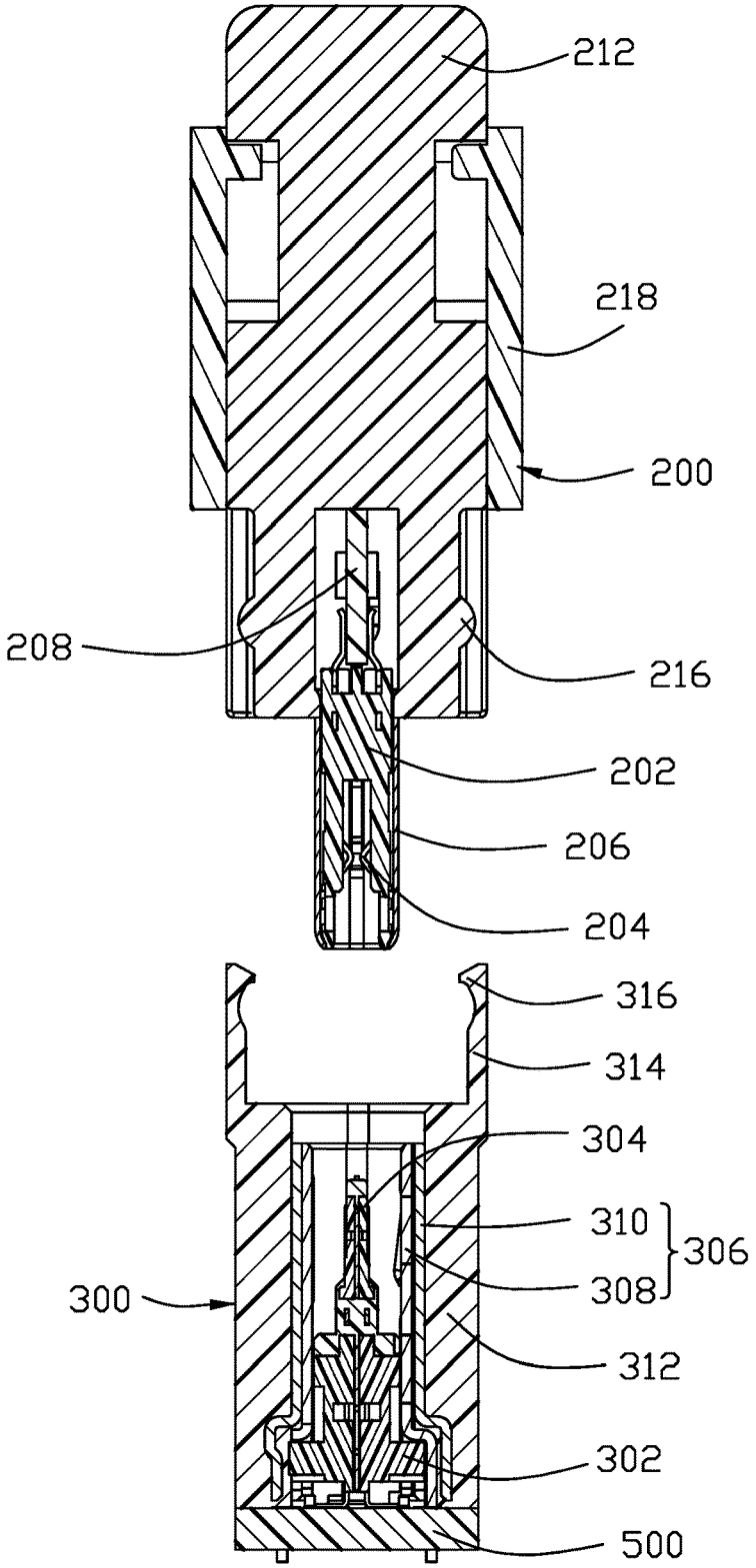
FIG. 8(A) is a cross-sectional view of the electrical connector assembly of FIG. 3(C) wherein the plug connector and the receptacle connector are un-mated from each other and the sliding assurance structure is located at the unlocking position.
Figure 8B:
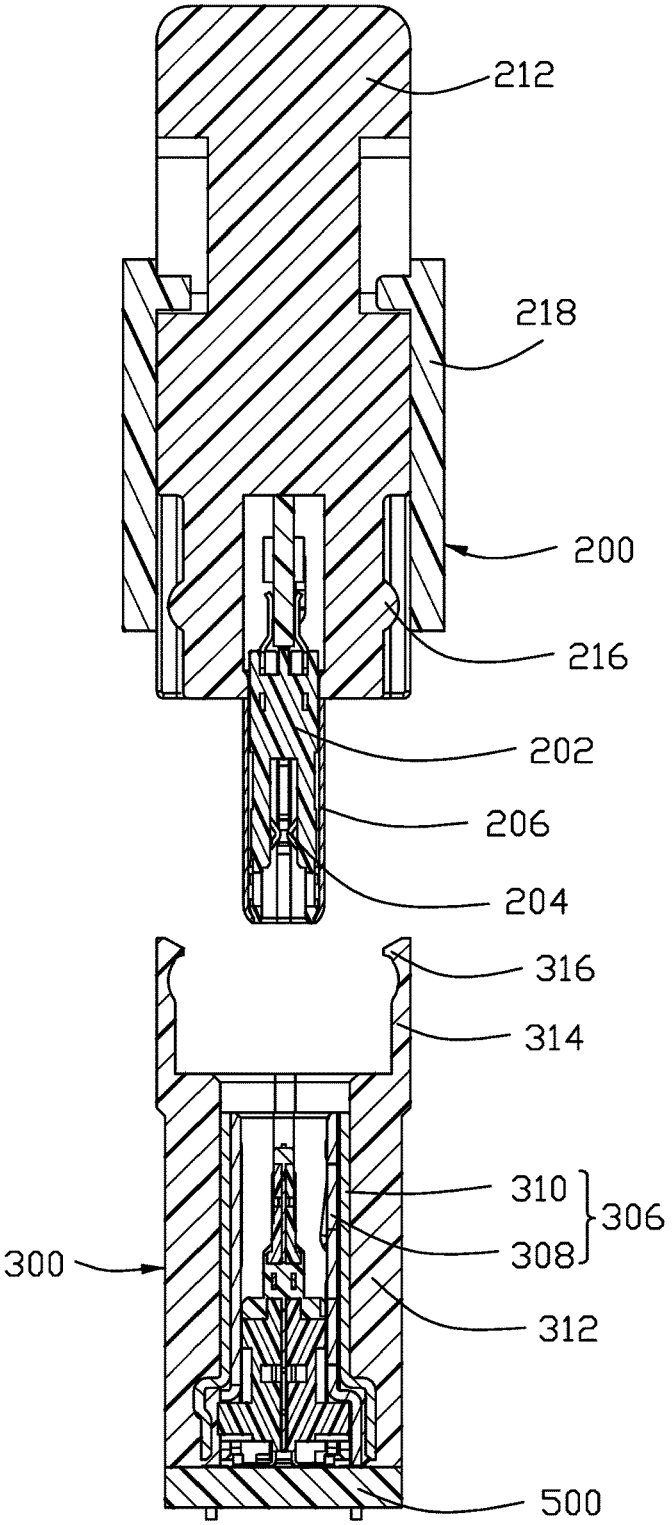
FIG. 8(B) is a cross-sectional view of the electrical connector assembly of FIG. 3(B) wherein the plug connector and the receptacle connector are un-mated from each other and the sliding assurance structure is located at the locking position.
Figure 8C:
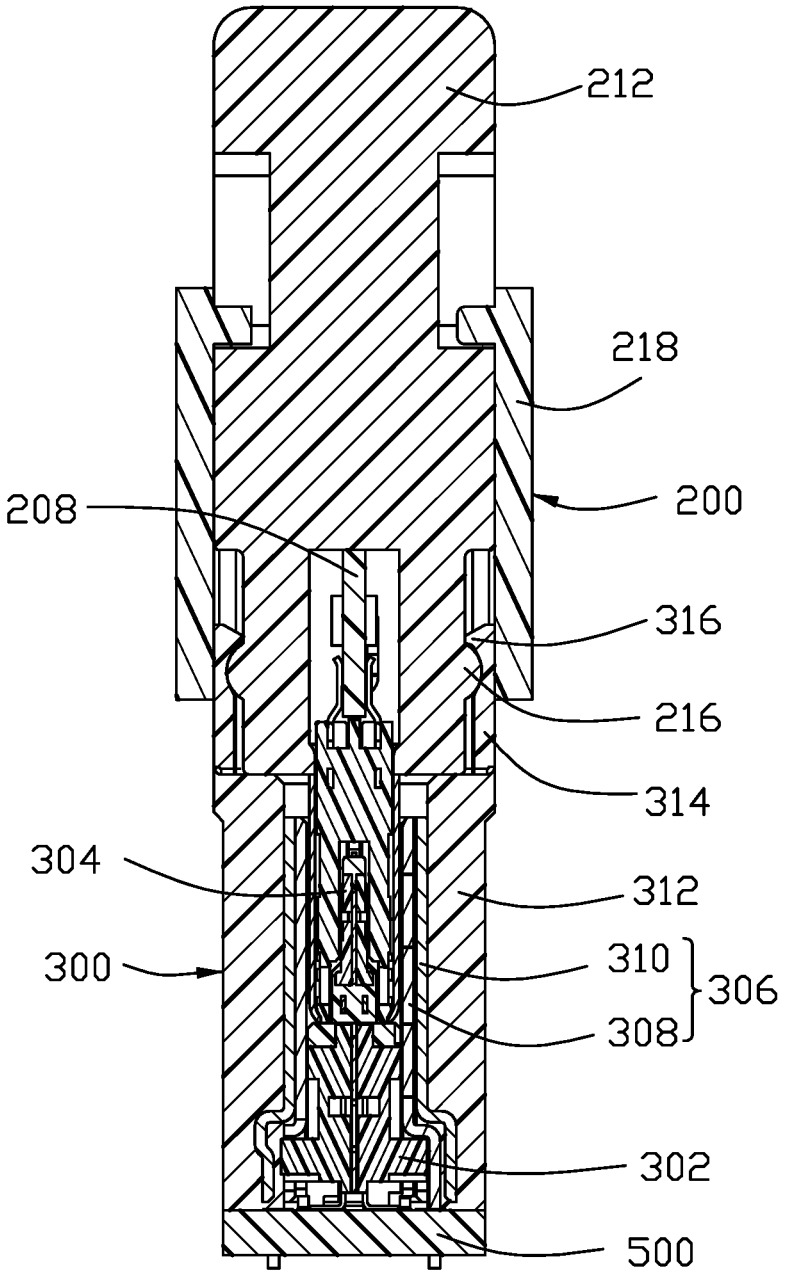
FIG. 8(C) is a cross-sectional view of the electrical connector assembly of FIG. 1(A) wherein the plug connector and the receptacle connector are mated with each other with the sliding assurance structure is located in the locking position.

Referring to FIGS. 1-8(C), and FIGS. 10-14, the electrical connector assembly 100 having a Type C interface, includes a plug connector 200 and a receptacle connector 300 adapted to be mated with each other. In this embodiment, the receptacle connector 300 is a vertical type upstanding upon a PCB 500 The receptacle connector 300 includes an insulative housing 302 with a plurality of receptacle contacts 304 therein wherein the insulative housing 302 forms a mating tongue with contacting sections of the contacts 304 thereon. A metallic shield sub-assembly 306 encloses the insulative housing 302 with a capsular cross-section thereof to define a capsular mating cavity for receiving the mating port of the plug connector 200 therein. The shield sub-assembly 306 includes an inner shield 308 and an outer shield 310 welded with each other wherein the outer shield 310 has less holes therein for being adapted to be molded with an insulative part. An insulative holder 312 is overmolded upon the sub-assembly 306 so as to protect and shield the shield sub-assembly. As a latching structure, a pair of deflectable latching arms 314 are unitarily formed on the insulative holder 312 and extend upwardly beyond an upper edge of the insulative holder 312, wherein each deflectable latching arm 314 is equipped with a locking hook 316 at a front free end. The contact legs of the contacts 304, and the mounting legs of the shield sub-assembly 306 are mounted to the PCB 500. Notably, in this embodiment, the housing 302 and the corresponding receptacle contacts 304 are integrally formed together as a terminal module 303 via an insert-molding method, and a metallic shielding plate is embedded within the housing 302 between two rows of the receptacle contacts 304.

The plug connector 200 includes an insulative body 202 with a plurality of plug contacts 204 therein wherein the insulative body 202 forms a receiving space to receive the mating tongue of the receptacle connector 300. A metallic shell 206 encloses the insulative body 202 with a capsular cross-section thereof. An internal PCB or paddle card 208 is located behind the insulative body 202 and electrically and mechanically connected to the plug contacts 204. A cable 210 with plural wires therein, is electrically and mechanically connected to the internal PCB 208. An insulative cover 212 encloses the internal PCB 208, the rear portion of the insulative body 202 and the front portion of the cable 210. A retaining structure 214 includes a pair of protrusions 216 formed upon the cover 212 to be engaged with the locking hooks 316 of the corresponding latching arms 314 so as to latch the plug connector 200 and the receptacle connector 300 together.

A sliding assurance structure 218 formed on the cover 212, is movable along the vertical direction between a lower locking position and an upper unlocking position wherein when the sliding assurance structure 218 is moved to the locking position, the assurance structure 218 may transversely/inwardly abut against the latching arms 314 so as to prevent the outward deflection of the latching arms 314 for assuring secure engagement between the protrusions 216 of the plug connector 200 and the hook 316 of the receptacle connector 300, thus guaranteeing mating between the plug connector 200 and the receptacle connector 300. A spring 220 assembled upon a pole 219 of the sliding assurance structure 218, is received within a groove 222 in the cover 212 to constantly urge the assurance structure 218 forwardly so as to assure the assurance structure 218 to be located in the front locking position. In opposite, when the assurance structure is moved to the upper unlocking position, the assurance structure 218 no longer abuts against the corresponding latching arms 314 so as to allow outward deflection of the spring arms 314 to implement the mating/un-mating process thereof. In this embodiment, the assurance structure 218 includes a guiding post 224 moveable along a guiding slot 226 in the cover 212 so as to assure movement of the assurance structure 218 along the front-to-back direction.

Figure 9A:
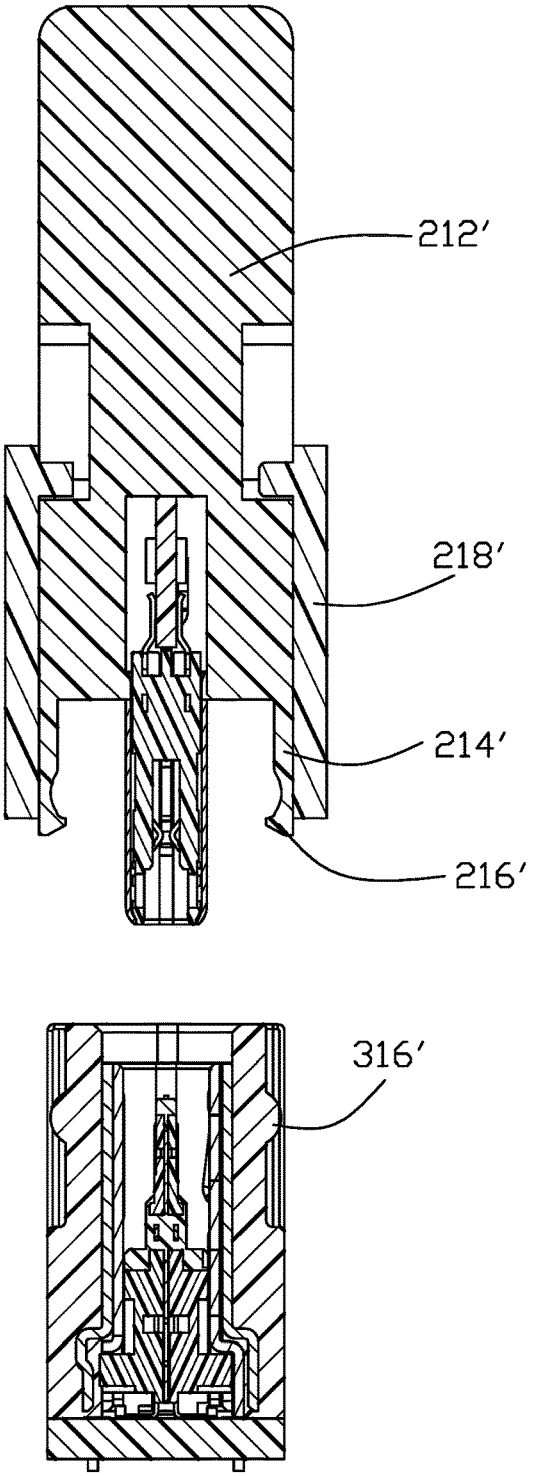
FIG. 9(A) is a cross-sectional view of the electrical connector assembly according to another embodiment of the invention when the plug connector and the receptacle connector are un-mated with each other, wherein the deflectable latching structure is positioned upon the plug connector instead of the receptacle connector.
Figure 9B:
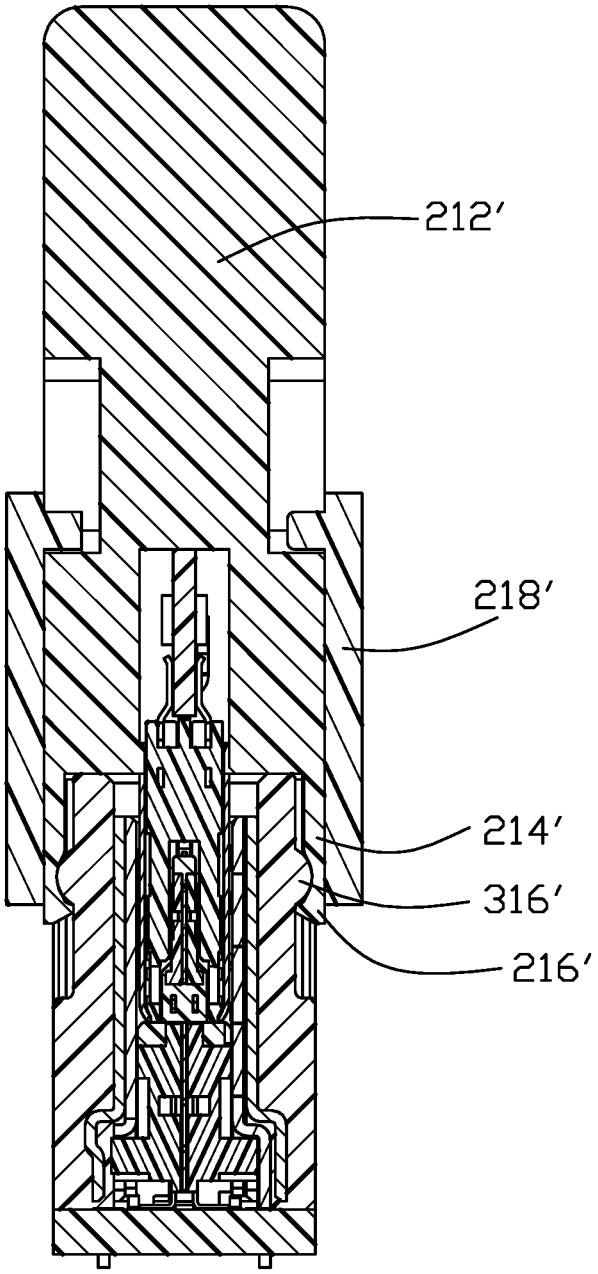
FIG. 9(B) is a cross-sectional view of the electrical connector assembly of FIG. 9(A) when the plug connector and the receptacle connector are un-mated from each other.
Figure 10:
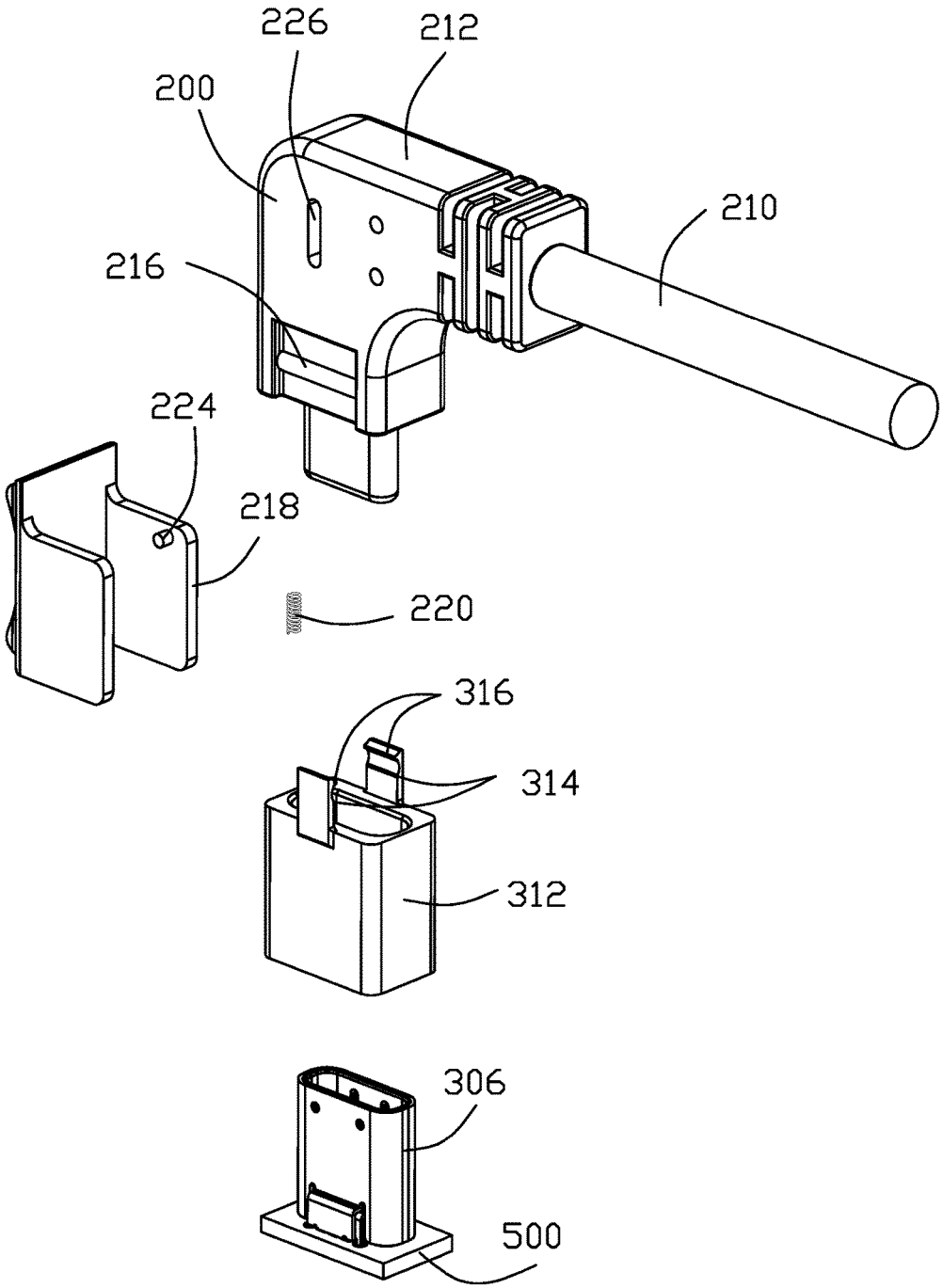
FIGS. 10-14 show the three dimensional drawings reflecting the same invention mentioned in FIGS. 1-8(C).
Figure 11:
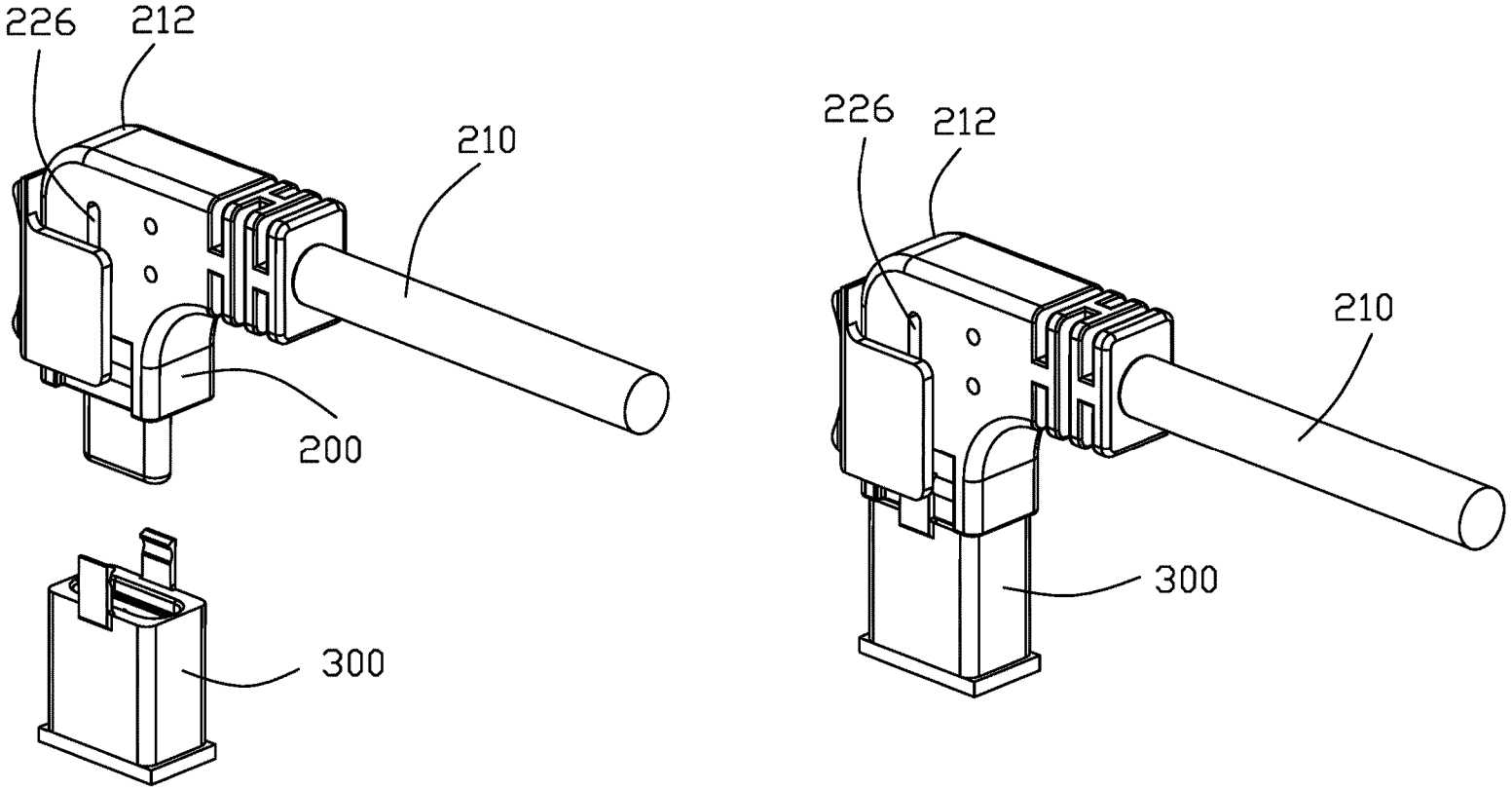
Figure 12:
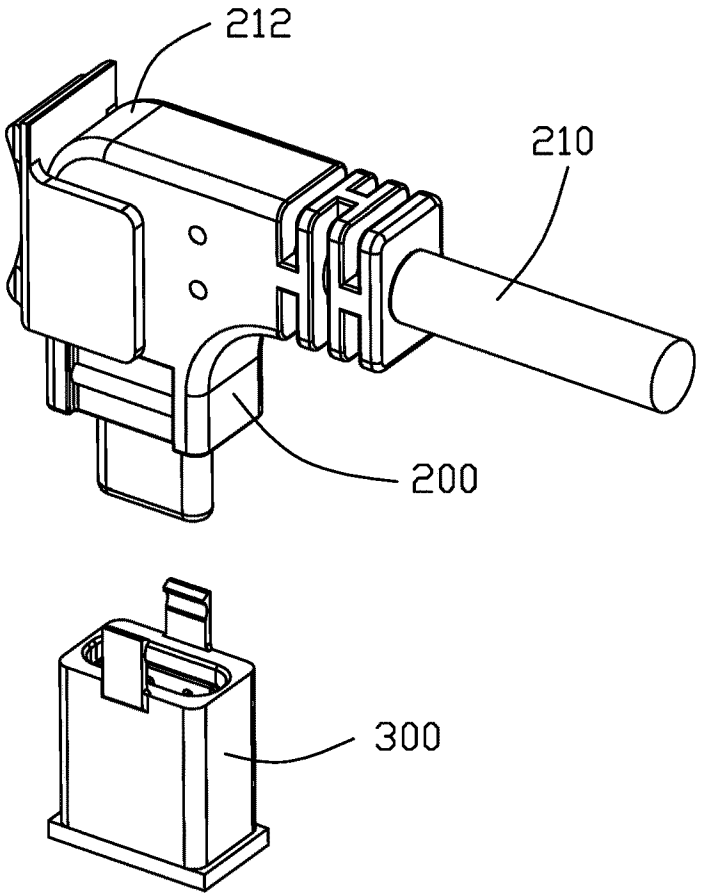
Figure 12:
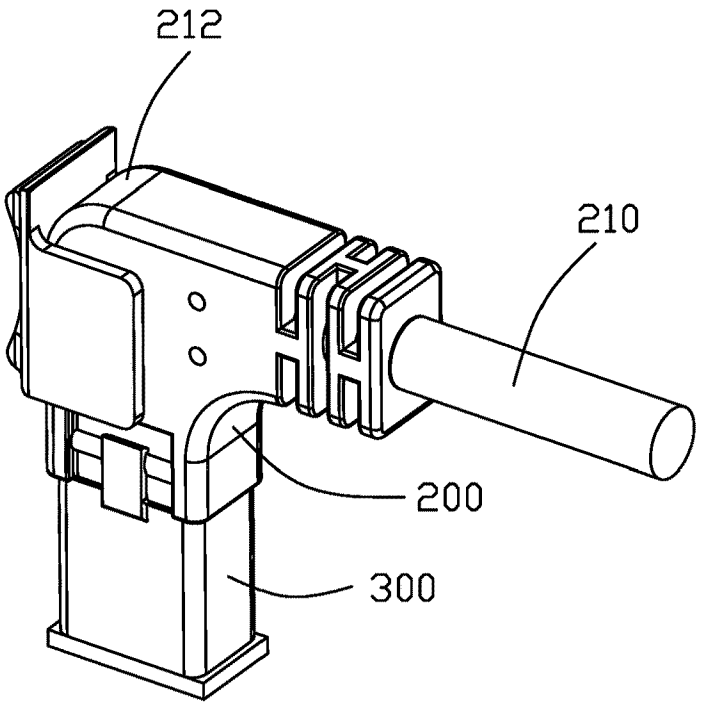
Figure 13:
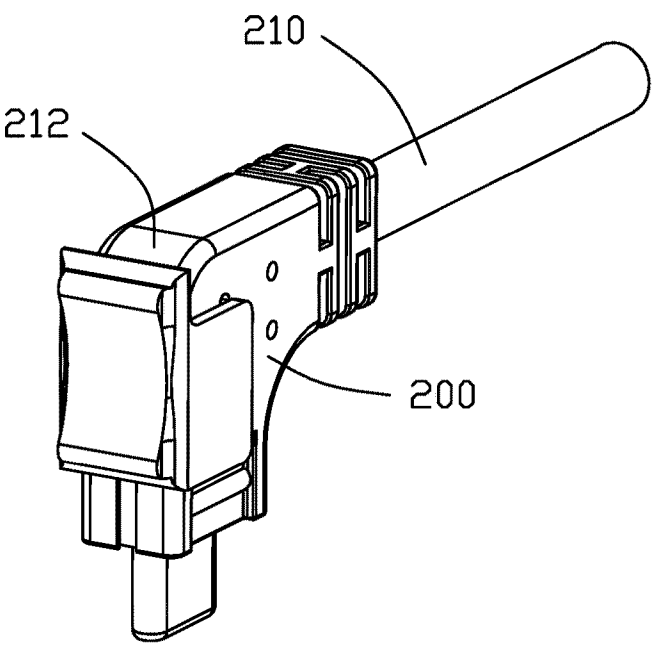
Figure 13:
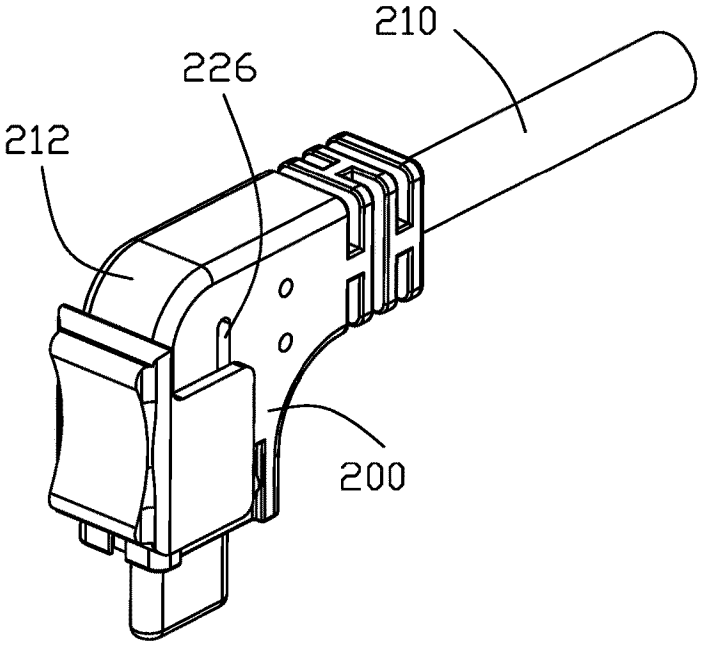
Figure 14:
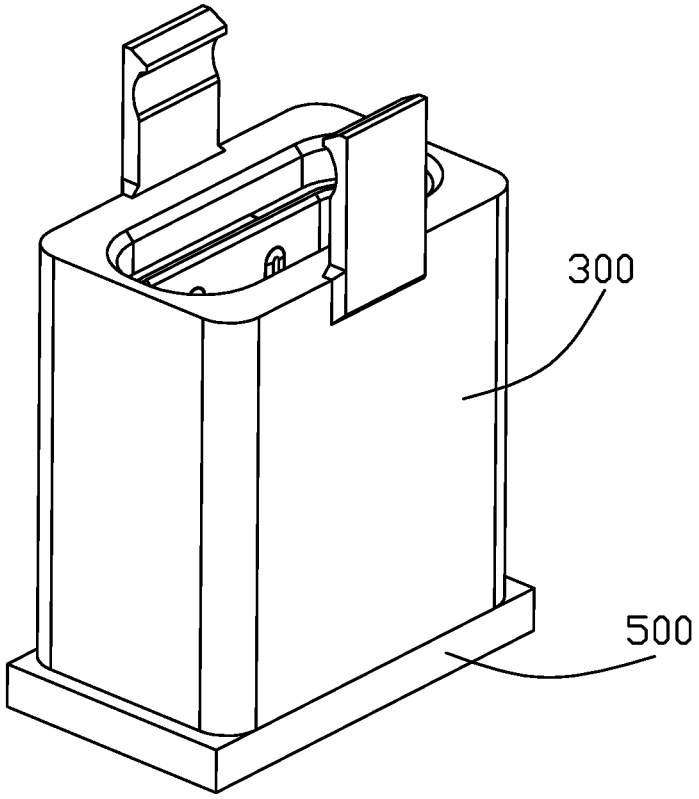

FIGS. 9(A) and 9(B) show another embodiment where the deflectable latching arms 214' are formed on the cover 212' with the sliding assurance structure 218' intimately located thereabouts while the protrusions 316' of the corresponding retaining structure 314' are formed on the insulative holder 312'. Understandably, similar to the first embodiment, the sliding assurance structure 218' may be moved between the upper unlocking position to free the latching arms 214' for implementing the mating/un-mating process, and a lower locking position to restrain the latching arms 214' for secure mating between the plug connector 200' and the receptacle connector 300'.

Understandably, on one hand the assurance structure 218' may be operated in a rotation or translation manner, or in a linear movement in a direction different from the vertical direction. On the other hand, the assurance structure 218' and the latching structure 214' may be unified or simplified as one piece to be a deflectable or pivotal latch as long as the hook 216' of the latching structure 214' may be securely engaged with the corresponding protrusion 316'. Notably, both embodiments disclose the mating/insertion force during the mating process along the vertical direction being somewhat larger than the conventional one due to the required deflection force of the deflection arms. Anyhow, in an alternate embodiment, the deflectable arm in a relaxed manner may be free from the corresponding protrusion while being forcibly deflected to be engaged with the protrusion after the assurance structure is moved to the locking position. Moreover, for the pivotal design, the pivotal latch may be provided with a torsion spring to urge the pivotal latch to be moved to the locking position. From a technical viewpoint, the retaining structure 214, the latching structure 314 and the assurance structure 218 commonly form the so-called interlocking device disregarding which one is located upon the plug connector or the receptacle connector. In the invention, upward pulling the assurance structure 218 may simultaneously upwardly pull the plug connector 200 conveniently. In conclusion, the spirit of the invention is to provide a holding structure around the receptacle connector not only to protectively circumferentially shield the mating portion of the metallic shield of the receptacle connector for reinforcement consideration but also to securely latch the mated receptacle connector and plug connector together for avoid incautiously un-mating due to an undesired/unexpected exterior impact in the Type C connector assembly.

What is claimed is:

1. A USB (Universal Serial Bus) Type C electrical connector assembly comprising:

a Type C receptacle adapted to be mated with a Type C plug connector along a mating direction, said receptacle connector including an insulative housing with a plurality of receptacle contacts, and a metallic shield enclosing the housing to form mating cavity;

said plug connector including an insulative body with a plurality of plug contacts, and a metallic shell enclosing the body with a mating port to be received in the mating cavity, and a cover forming an exterior of the plug connector;

an insulative holder intimately surrounding the metallic shield to protectively circumferentially shield a mating portion of the metallic shield; and an interlocking device including a deflectable latching structure engageable with a retaining structure and restrained by an assurance structure; wherein said assurance structure is moveably located upon the cover of the plug connector while one of the latching structure and the retaining structure is formed on the cover of the plug connector and the other of the latching structure and the retaining structure is formed on the holder of the receptacle connector.

2. The USB Type C electrical connector assembly as claimed in claim 1, wherein the deflectable latching structure is formed on holder of the receptacle connector.

3. The USB Type C electrical connector assembly as claimed in claim 1, wherein the assurance structure is moved along the mating direction.

4. The USB Type C electrical connector assembly as claimed in claim 1, wherein said assurance structure is constantly urged by a spring to a locking position where the deflectable latching structure is restrained.

5. The USB Type C electrical connector assembly as claimed in claim 4, wherein said assurance structure is moveable to an unlocking portion away from the receptacle connector than the locking position.

6. The USB Type C electrical connector assembly as claimed in claim 1, wherein said insulative holder is overmolded upon the metallic shield.

7. The USB Type C electrical connector assembly as claimed in claim 1, wherein said plug connector is linked by a cable.

8. A USB (Universal Serial Bus) Type C electrical connector assembly comprising:

a Type C receptacle adapted to be mated with a Type C plug connector along a mating direction, said receptacle connector including an insulative housing with a plurality of receptacle contacts, and a metallic shield enclosing the housing to form mating cavity;

said plug connector including an insulative body with a plurality of plug contacts, and a metallic shell enclosing the body with a mating port to be received in the mating cavity, a cover forming an exterior of the plug connector;

an insulative holder intimately surrounding the metallic shield to protectively circumferentially shield a mating portion of the metallic shield; and an interlocking device including at least a moveable latching structure engageable with a retaining structure; wherein one of the latching structure and the retaining structure is formed on the cover of the plug connector and the other of the latching structure and the retaining structure is formed on the holder of the receptacle connector.

9. The USB Type C electrical connector assembly as claimed in claim 8, wherein the latching structure is deflectable.

10. The USB Type C electrical connector assembly as claimed in claim 9, wherein said latching structure is unitarily formed on the insulative holder.

11. A USB (Universal Serial Bus) Type C electrical connector assembly comprising:

a Type C receptacle adapted to be mated with a Type C plug connector along a mating direction, said receptacle connector including an insulative housing with a plurality of receptacle contacts, and a metallic shield enclosing the housing to form mating cavity;

said plug connector including an insulative body with a plurality of plug contacts, and a metallic shell enclosing the body with a mating port to be received in the mating cavity, and a cover forming an exterior of the plug connector;

an insulative holder intimately surrounding the metallic shield to protectively circumferentially shield a mating portion of the metallic shield; and an interlocking device including a deflectable latching structure engageable with a retaining structure and restrained by an assurance structure; wherein said assurance structure is located upon one of the plug connector and the receptacle connector, one of the latching structure and the retaining structure is formed on the cover of the plug connector and the other of the latching structure and the retaining structure is formed on the holder of the receptacle connector, and the assurance structure abuts against the latching structure transversely.

12. The USB Type C electrical connector assembly as claimed in claim 11, wherein the deflectable latching structure is formed on holder of the receptacle connector.

13. The USB Type C electrical connector assembly as claimed in claim 11, wherein the assurance structure is moved along the mating direction.

14. The USB Type C electrical connector assembly as claimed in claim 11, wherein said assurance structure is constantly urged by a spring to a locking position where the deflectable latching structure is restrained.

15. The USB Type C electrical connector assembly as claimed in claim 14, wherein said assurance structure is moveable to an unlocking portion away from the receptacle connector than the locking position.

16. The USB Type C electrical connector assembly as claimed in claim 11, wherein said insulative holder is overmolded upon the metallic shield.

17. The USB Type C electrical connector assembly as claimed in claim 11, wherein said plug connector is linked by a cable.

18. The USB Type C electrical connector assembly as claimed in claim 11, wherein said receptacle connector is mounted upon a printed circuit board.

19. The USB Type C electrical connector assembly as claimed in claim 11, wherein said assurance structure is located upon the cover of the plug connector.

* * * * *